US007277555B2

(12) United States Patent
Klein et al.

(10) Patent No.: US 7,277,555 B2
(45) Date of Patent: Oct. 2, 2007

(54) ELECTROACOUSTIC TRANSDUCER WITH BUILT IN TRANSDUCER CIRCUIT

(75) Inventors: Erich Klein, Himberg (AT); Michael Schoeffmann, Siegenfeld (AT)

(73) Assignee: NXP, B.V., Eindhoven (NL)

( * ) Notice: Subject to any disclaimer, the term of this patent is extended or adjusted under 35 U.S.C. 154(b) by 180 days.

(21) Appl. No.: 10/523,435

(22) PCT Filed: Jul. 18, 2003

(86) PCT No.: PCT/IB03/03275

§ 371 (c)(1),
(2), (4) Date: Jan. 28, 2005

(87) PCT Pub. No.: WO2004/014104

PCT Pub. Date: Feb. 12, 2004

(65) Prior Publication Data

US 2005/0244028 A1 Nov. 3, 2005

(30) Foreign Application Priority Data

Jul. 31, 2002 (EP) ..... 02102077

(51) Int. Cl.
*H04R 1/00* (2006.01)

(52) U.S. Cl. ..... 381/409; 381/412

(58) Field of Classification Search ..... 381/87, 381/111, 115, 117, 394, 400, 420
See application file for complete search history.

(56) References Cited

U.S. PATENT DOCUMENTS

| | | | | |
|---|---|---|---|---|
| 5,583,945 | A * | 12/1996 | Iijima et al. | 381/412 |
| 6,072,886 | A * | 6/2000 | Frasl et al. | 381/409 |
| 6,243,472 | B1 * | 6/2001 | Bilan et al. | 381/117 |
| 6,370,257 | B1 * | 4/2002 | Bleim et al. | 381/409 |
| 6,385,328 | B1 * | 5/2002 | Yoo et al. | 381/412 |
| 6,463,161 | B2 * | 10/2002 | Klein et al. | 381/409 |
| 6,671,384 | B1 * | 12/2003 | Klein | 381/409 |

* cited by examiner

*Primary Examiner*—Sinh Tran
*Assistant Examiner*—Joseph Saunders, Jr.
(74) *Attorney, Agent, or Firm*—Peter Zawilski

(57) ABSTRACT

In an electroacoustic transducer (1), an annular shaped magnet system (14) is provided, enclosing an inner space (22), in which inner space (22) an integrated circuit (31) is accommodated, with the aid of which integrated circuit (31) an electrical signal to be sent to a moving coil (29) of transducer (1) can be amplified.

5 Claims, 1 Drawing Sheet

ELECTROACOUSTIC TRANSDUCER WITH BUILT IN TRANSDUCER CIRCUIT

The invention relates to an electroacoustic transducer with a transducer axis and comprising a membrane, which membrane is arranged perpendicular to the transducer axis so as to be oscillatory, and comprising a magnet system, which magnet system is equipped with two magnet-system components, which magnet-system components bound an air gap, and comprising a moving coil, which moving coil is, in part, arranged in the air gap and is connected to the membrane, and comprising a circuit module, which circuit module is equipped with a circuit frame and at least one circuit component of a transducer circuit, mounted on the circuit frame.

An electroacoustic transducer in accordance with the generic type cited in the first paragraph above is known from patent document U.S. Pat. No. 6,243,472 B1. In the known transducer, a multiplicity of circuit components are provided on the board-shaped circuit frame of the circuit module, wherein these circuit components are all mounted on the circuit frame carrier surface that faces away from the membrane. The result of this is that, parallel with the direction of the transducer axis, the circuit components protrude from the circuit frame carrier surface that faces away from the membrane and therefore occupy a space, which leads to an increase in the space requirement of the known transducer in the direction of the transducer axis. Although such an increase in space requirement in the direction of the transducer axis does not occur in a further electroacoustic transducer known from cited patent document U.S. Pat. No. 6,243,472 B1 because, in this further known transducer the circuit module is accommodated within the magnet system, however, in this further known transducer, no repairs can be made to the circuit module and no exchanging of the circuit module can take place in the event of a non-operational circuit module—which may be caused by e.g. a defective circuit component—so the entire electroacoustic transducer then has to be replaced.

It is an object of the invention to eliminate the above-mentioned disadvantageous circumstances and to realize an improved electroacoustic transducer.

To achieve the above-mentioned object, features in accordance with the invention are provided in an electroacoustic transducer in accordance with the invention, so that an electroacoustic transducer in accordance with the invention may be characterized in the following manner, namely:

Electroacoustic transducer with a transducer axis and comprising a membrane, which membrane is arranged perpendicular to the transducer axis so as to be oscillatory, and comprising a magnet system, which magnet system is equipped with two magnet-system components bounding an air gap, and comprising a moving coil, which moving coil is, in part, arranged in the air gap and is connected to the membrane, and comprising a circuit module, which circuit module is equipped with a circuit frame and at least one circuit component of a transducer circuit, mounted on the circuit frame, wherein the magnet system is arranged in an annular shape and encloses an inner space, which inner space is accessible from outside the magnet system during production of the transducer and before the circuit module is mounted, and wherein the at least one circuit component is arranged on a first carrier surface of the circuit frame which first carrier surface faces the membrane, and in the inner space of the magnet system.

By providing the features in accordance with the invention, firstly, an especially space-saving design of an electroacoustic transducer with a built-in transducer circuit is enabled in a structurally simple manner, since the board-shaped circuit frame may be of an extremely thin design, and the at least one circuit component mounted on the circuit frame is accommodated within the inner space of the magnet system and therefore takes up no additional space parallel to the transducer axis, and secondly, it is advantageously achieved that the circuit module is accessible easily and simply even after the completion of the electroacoustic transducer, and, in the event that operation is unsatisfactory, may be replaced in an easy and simple way.

In an electroacoustic transducer in accordance with the invention, multiple discrete circuit components may be provided on the circuit frame to create a transducer circuit. A transducer circuit of this kind may also be realized in thin-film technology. It has, however, proved very advantageous if just a single circuit component is provided, which takes the form of an integrated circuit connected to the circuit frame, which integrated circuit forms the transducer circuit. An especially small, space-saving solution can be realized as a result.

In an embodiment with an integrated circuit, it has further proved very advantageous if, in addition, the features as claimed in claim 3 are provided. A solution of this kind is advantageous in respect of the simplest possible embodiment of the electrically conductive connection between the moving coil and the transducer circuit.

In an electroacoustic transducer in accordance with the invention, connecting contacts running parallel with one another in the form of spots or strips may be provided on a second carrier surface of the circuit frame which second carrier surface facing away from the membrane. It has, however, proved very advantageous if four connecting contacts, each having the shape of an annular sector, are provided on a second carrier surface of the circuit frame which second carrier surface faces away from the membrane. An embodiment of this kind has proved especially advantageous in practice.

The circuit module may be secured with, for example, at least one screw. It has, however, proved especially advantageous if the circuit module is designed to be removable without a separate tool. To this end, for example, a latching connection or a bayonet connection may be provided between the circuit module and another component of the transducer. An interference fit, which may be extensive to a greater or lesser extent, may also be provided between the circuit module and another component of the transducer.

The above aspects and further aspects of the invention are explained below.

The invention will be further described with reference to examples of embodiments shown in the drawings, to which, however, the invention is not restricted.

Figure 1:
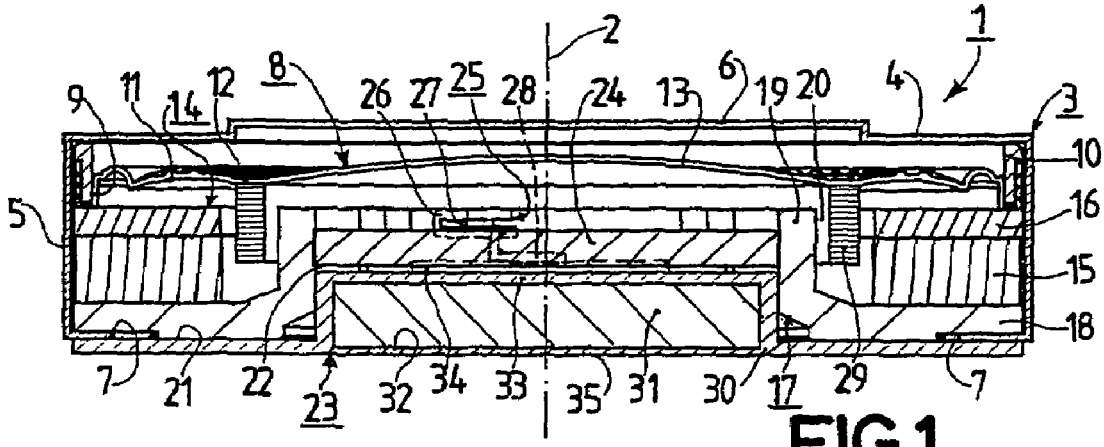
FIG. 1 shows, in cross-section, an electroacoustic transducer in accordance with a first embodiment of the invention, which transducer is provided with a circuit module.

FIG. 1 shows an electroacoustic transducer 1, which in this case is a loudspeaker 1. Transducer 1 is essentially centrally symmetrical in design, and has a transducer axis 2.

The transducer 1 has a pot-shaped housing 3, which is made of metal and which is equipped with a base wall 4 and a side wall 5, wherein the base wall 4 is provided with a circular elevation 6, in which circular elevation 6 sound transmission openings are provided (not shown) and wherein four strip-shaped lugs 7, running in radial directions in relation to transducer axis 2, protrude from side wall 5, with the aid of which lugs 7 the components of transducer 1 accommodated in housing 3 are secured in their axial positions. More than four lugs 7 of this kind may also be provided. The radial positions of the components of transducer 1 which are accommodated in housing 3 are defined with the aid of side wall 5. In the direction of transducer axis 2 and in the area of transducer axis 2, the pot-shaped housing 3 has a height of 3.2 mm. The diameter of housing 3 in the directions running perpendicular to the direction of transducer axis 2 is 13.2 mm. In this case, therefore, transducer 1 is of an especially small design. Transducer 1 is provided for use in e.g. a mobile telephone or in similar telecommunications apparatuses, which apparatuses need to be especially small, so the components used therein, like transducer 1, also need to be especially small and take up little space. Consequently, it is advantageous in relation to a transducer 1 of this kind if its dimensions are smaller in comparison with known transducers, even if by only a few tenths of a millimeter.

The transducer 1 contains a membrane 8, which is essentially U-shaped in its peripheral area 9, wherein the U-shaped peripheral area 9 is connected to a ring 10, which ring 10 is connected to membrane 8 when membrane 8 is produced, and which ring 10 serves for transport purposes and also for assembly purposes. When transducer 1 is produced, ring 10, including the membrane 8 which is connected to it, is inserted into housing 3 in parallel with, the direction of transducer axis 2, wherein the lugs 7 have, of course, not yet been bent over and extend in a direction running essentially parallel with transducer axis 2. Membrane 8 has an intermediate area 11 adjacent to U-shaped peripheral area 9, and an annular securing area 12 adjacent to intermediate area 11, and a central area 13 located within securing area 12, which central area 13 serves for sound generation. To this end, membrane 8 as a whole is arranged perpendicular to transducer axis 2 so as to be oscillatory.

Figure 2:
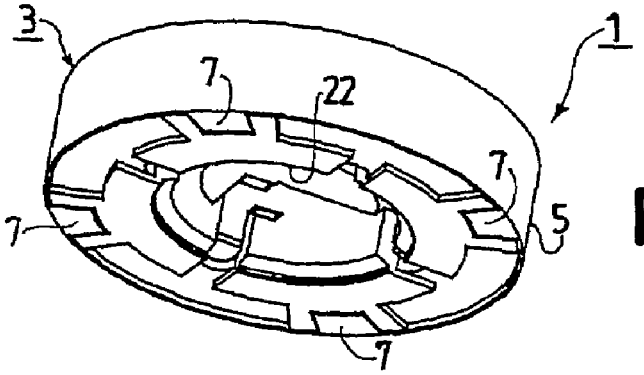
FIG. 2 shows, in an oblique view from behind, the transducer in accordance with FIG. 1 without the circuit module.

The transducer 1 is further equipped with a magnet system 14. Magnet system 14 comprises a permanent magnet 15 and an annular first yoke 16, which yoke 16 is located tight against permanent magnet 15, and a second yoke 17, having an L-shaped cross-sectional shape, of which second yoke 17, one disk-shaped first section 18 is likewise located tight against permanent magnet 15, and a hollow-cylindrical second section 19 protrudes from first section 18 parallel with transducer axis 2. When transducer 1 is produced, firstly first yoke 16, then permanent magnet 15 and then second yoke 17 are inserted into housing 3 parallel with the direction of transducer axis 2. Once the three components 16, 15 and 17 of the magnet system have been inserted, lugs 7 of housing 3 are bent over into their positions as shown in FIG. 1 and FIG. 2, as a result of which membrane 8 and magnet system 14 are fixed. An air gap 20 is formed between the free end of second section 19 of second yoke 17 and the inner edge of first yoke 16, which air gap 20 is bounded by the two components of the magnet system, namely first yoke 16 and second yoke 17. Magnet system 14 has a boundary surface 21, which faces away from membrane 8 and bounds magnet system 14 externally, and which boundary surface 21 is formed by an annular surface of first section 18 of second yoke 17.

As can be seen from FIG. 1 and FIG. 2, magnet system 14 advantageously takes an annular shape in the present case. Magnet system 14 encloses an inner space 22, which inner space 22, when magnet system 14 is produced, is accessible from outside magnet system 14 over its entire extent, located perpendicular to transducer axis 2, before circuit module 23—the design of which will be described below—is fitted, and which inner space 22 is permeated by transducer axis 2.

Fixed in inner space 22 is a contact carrier 24, which contact carrier 24 is made of plastic and is provided to hold two moving-coil contacts 25, only one of which moving-coil contacts 25 is visible in FIG. 1 owing to the sectional view. Moving-coil contacts 25 are connected to a contact carrier 24 by means of extrusion. Each moving-coil contact 25 is equipped with a U-shaped section 26, between the two legs of which an end 27 of a moving-coil wire is clamped. Each moving-coil contact 25 is equipped with an L-shaped section 28, which protrudes from a leg of U-shaped section 26.

The transducer 1 contains a moving coil 29, which moving coil 29 is partly arranged in air gap 20 and is connected to membrane 8 in its securing area 12 with the aid of an adhesive connection, which is not shown. Moving coil 29 interacts with magnet system 14, wherein an electrical signal representing a signal to be reproduced acoustically is sent to moving coil 29, as a result of which moving coil 29 is caused to oscillate, which results in membrane 8 bringing about the signal to be reproduced acoustically. The electrical signal sent to moving coil 29 must be amplified and, if applicable, its signal waveform must be influenced, before being sent to moving coil 29. A transducer circuit, which is designed to undertake the necessary signal influencing, especially to amplify the signal, is required for this purpose.

In the transducer 1, this transducer circuit is directly connected to transducer 1. The already-mentioned circuit module 23 is provided in the transducer 1 for this purpose. The circuit module 23 is equipped with a board-shaped circuit frame 30, which circuit frame 30 is arranged adjacent to the boundary surface 21 of the annular magnet system 14 in the axial direction. Provided on and attached to board-shaped circuit frame 30 in the present case is just a single circuit component 31, which is formed by an integrated circuit 31 connected to circuit frame 30, which integrated circuit 31 is indicated only schematically in FIG. 1, and which integrated circuit 31 forms the transducer circuit. Integrated circuit 31 is hereby arranged in an advantageous manner on a first carrier surface 32 of circuit frame 30 that faces membrane 8. This gives rise to the fact that integrated circuit 31 is arranged in the inner space 22 of magnet system 14, as a result of which the great advantage is achieved that, for accommodating integrated circuit 31, advantage is taken of the space that is available anyway in inner space 22, so that no additional space is required for accommodating integrated circuit 31, which is advantageous in respect of the lowest possible height of transducer 1, including the transducer circuit. Integrated circuit 31 is hereby embedded in an essentially pot-shaped plastic jacket 33. Protruding from plastic jacket 33 are two connection contacts 34, connected to this plastic jacket 33 by extrusion, each of which connection contacts 34 is connected to a moving-coil contact 25 to be electrically conductive, wherein the electrically conductive connection is realized, in each case, between a connection contact 34 and an L-shaped section 28 of a moving-coil contact 25. Each of the two connection contacts 34 is connected to a (not shown) terminal of integrated circuit 31. In this case, circuit frame 30 takes the form of a small printed circuit board, to which plastic jacket 33 is connected. However, circuit frame 30 and plastic jacket 33 may also comprise one piece, wherein circuit frame 30 is then also made of plastic, as a result of which an especially simple, advantageous embodiment is achieved.

Figure 3:
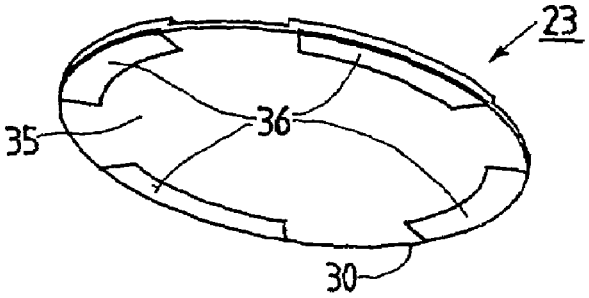
FIG. 3 shows, in an oblique view from behind, the circuit module of the transducer in accordance with FIG. 1.
Figure 4:
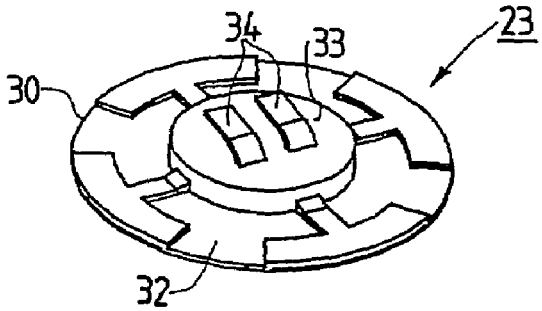
FIG. 4 shows, in an oblique view from in front, the circuit module of the transducer in accordance with FIG. 1.

As can be seen in FIG. 3, four terminal contacts 36, each taking the form of an annular sector, are provided on a second carrier surface 35 of circuit frame 30 that faces away from membrane 8. Two of these terminal contacts 36 serve for sending the electrical signal to be reproduced as an acoustic signal. Two other of these terminal contacts 36 serve for sending a direct supply voltage for the integrated circuit 31.

In the present case, circuit module 23 is secured with the aid of a latching connection, not shown in the Figures. This latching connection is realized between the contact carrier 24 and the plastic jacket 33. The latching connection may, however, also be provided between other components of transducer 1, e.g. between the second yoke 17 and circuit frame 30. By virtue of the securing of circuit module 23 with the aid of a latching connection, circuit module 23 can be removed from the remainder of transducer 1 without separate tools. Circuit module 23 is thereby of a design that can be removed without separate tools. Circuit module 23 may, however, also be secured with the aid of quick-release snap connection or bayonet connection. Circuit module 23 may also be secured with the aid of e.g. spot-shaped adhesive connections or spot-shaped weld connections.

With the transducer 1, it is achieved in an especially advantageous manner that, firstly, only a very small additional space requirement is necessary in the direction of transducer axis 2 for accommodating integrated circuit 31, namely the space necessary for the board-shaped circuit frame 30, which is, however, only a few tenths of a millimeter, and that, secondly, circuit module 23 is accessible simply and easily even after the completion of transducer 1, and can be replaced simply and easily in the event that circuit module 23 is not operating satisfactorily.

In a modification of the transducer 1 in accordance with FIGS. 1 to 4, no circuit frame extending as far as side wall 5 of housing 3 is provided; instead, circuit frame 30 has an outside diameter that is only equal to the inside diameter of the inner space 22, and plastic jacket 33, together with circuit frame 30, occupies only a height such that the second carrier surface 35 of circuit frame 30 that faces away from membrane 8 is in alignment with boundary surface 21 of magnet system 14, or even lies somewhat offset into the inner space in relation to boundary surface 21 in the axial direction, so that, in this case too, circuit frame 30 is arranged adjacent to boundary surface 21 of magnet system 14, specifically adjacent essentially in the radial direction. As a result, there is no additional space requirement whatever in the direction of transducer axis 2 for accommodating the circuit module 23, which contains integrated circuit 31. In this modification of transducer 1, circuit frame 30 may take the form of a base wall of the plastic jacket 33.

As regards circuit module 23, it should also be mentioned that circuit module 23 is of an SMD-capable (Surface Mount Device) design and therefore can be connected by an SMD method to a PCB (Printed Circuit Board) of a mobile telephone or a similar apparatus. Circuit module 23 thereby forms an SMD-capable adapter for transducer 1, wherein this adapter can be connected, or cannot be connected, to the remainder of transducer 1, depending on client request or application case.

It should be further mentioned that an intermediate layer may also be provided between the boundary surface 21 of magnet system 14 that faces away from membrane 8 and the first carrier surface 32 of circuit frame 30 that faces membrane 8, which intermediate layer is designed to achieve an especially good thermal transmission between the circuit frame 30 and the second yoke 17 of magnet system 14.

As regards transducer 1, it should also be mentioned that it is also possible for no circuit module 23 to be supplied for transducer 1, i.e. to supply the client with a transducer 1 without a circuit module 23 of this kind for installation in a mobile telephone or a similar apparatus, wherein a transducer 1 of this kind supplied without a circuit module 23 then has to be supplied with the electrical signal to be reproduced acoustically from a transducer circuit external to transducer 1, wherein this external transducer circuit is directly connected to the L-shaped sections 28 of the two moving-coil contacts 25.

It may be mentioned that an electroacoustic transducer in accordance with the invention may also be a microphone.

The invention claimed is:

1. An electroacoustic transducer with a transducer axis and comprising a membrane, which membrane is arranged perpendicular to the transducer axis so as to be oscillatory, wherein the membrane includes an intermediate area adjacent to a U-shaped peripheral area and an annular securing area adjacent to the intermediate area, and a central area located within the annular securing area, said central area serves for sound generation, and comprising a magnet system, which magnet system is equipped with two magnet-system components, which magnet-system components bound an air gap, and comprising a moving coil, which moving coil is, in part, arranged in the air gap and is connected to the membrane, and comprising a circuit module, which circuit module is equipped with a circuit frame and one single circuit component which forms a transducer circuit, the one single circuit component mounted on the circuit frame, the one single circuit component being an integrated circuit connected to the circuit frame, wherein the magnet system is arranged in an annular shape and encloses an inner space, which inner space is accessible from outside the magnet system during production of the transducer and before the circuit module is mounted, and wherein the at least one circuit component is arranged on a first carrier surface of the circuit frame which first carrier surface faces the membrane, and in the inner space of the magnet system.

2. An electroacoustic transducer as claimed in claim 1, wherein the integrated circuit is embedded in a plastic jacket and wherein two connection contacts are provided on the plastic jacket, each of which connection contacts is connected to a moving-coil contact.

3. An electroacoustic transducer as claimed in claim 1, wherein four connecting contacts, each having the shape of an annular sector, are provided on a second carrier surface of the circuit frame which second carrier surface faces away from the membrane.

4. An electroacoustic transducer as claimed in claim 1, wherein the circuit module is of a design that can be removed without separate tools.

5. An electroacoustic transducer as claimed in claim 1, wherein the transducer has a pot-shaped housing wherein, in the direction of the transducer axis, its height has a value between 2.0 mm and 5.0 mm and its diameter perpendicular to the direction of the transducer axis has a value between 6.0 mm and 20.0 mm.

* * * * *